US008347567B2

(12) United States Patent
Nolan et al.

(10) Patent No.: US 8,347,567 B2
(45) **Date of Patent: *Jan. 8, 2013**

(54) WATER BARRIER TRIM

(75) Inventors: Patrick Nolan, Royersford, PA (US); Michael A. Dotsey, Pottstown, PA (US)

(73) Assignee: AZEK Building Products, Inc., Scranton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/986,413

(22) Filed: Jan. 7, 2011

(65) Prior Publication Data

US 2012/0174496 A1 Jul. 12, 2012

(51) Int. Cl.
*E06B 1/04* (2006.01)

(52) U.S. Cl. ..... 52/213; 52/60; 52/302.7; 52/97; 52/58; 49/504

(58) Field of Classification Search ..... 52/58, 60–62, 52/302.6, 302.7, 287.1, 288.1, 97, 520, 551, 52/290, 293.3, 302.1, 211–213; 49/540, 49/504

See application file for complete search history.

(56) References Cited

U.S. PATENT DOCUMENTS

| | | | | |
|---|---|---|---|---|
| 1,767,569 | A | | 6/1930 | Anderson |
| 3,442,055 | A | | 5/1969 | Posey |
| 4,055,916 | A | | 11/1977 | Yamamoto et al. |
| 4,601,149 | A | | 7/1986 | Dokan |
| 4,660,463 | A | * | 4/1987 | Bottomore et al. ..... 454/260 |
| 4,999,957 | A | * | 3/1991 | Kessler ..... 52/213 |
| 5,119,609 | A | * | 6/1992 | Tait et al. ..... 52/213 |
| 5,321,921 | A | | 6/1994 | Holt |
| 5,507,123 | A | | 4/1996 | Holt |
| 5,590,496 | A | * | 1/1997 | Martin et al. ..... 52/213 |
| 5,644,878 | A | * | 7/1997 | Wehrmann ..... 52/287.1 |
| 5,735,035 | A | | 4/1998 | Holt |
| 5,884,435 | A | | 3/1999 | David et al. |
| 6,047,502 | A | * | 4/2000 | Kimmitt et al. ..... 52/12 |
| 6,223,484 | B1 | * | 5/2001 | Minter ..... 52/213 |
| 7,673,421 | B2 | | 3/2010 | Pilz |
| 7,784,238 | B2 | * | 8/2010 | Bannister ..... 52/465 |
| 2005/0166471 | A1 | * | 8/2005 | Allen ..... 52/58 |
| 2005/0204657 | A1 | * | 9/2005 | Ellingson ..... 52/204.1 |
| 2008/0178557 | A1 | * | 7/2008 | Parsons et al. ..... 52/741.1 |
| 2009/0229193 | A1 | | 9/2009 | Ellingson |
| 2010/0212234 | A1 | * | 8/2010 | Monteer ..... 52/95 |

* cited by examiner

*Primary Examiner* — William Gilbert
*Assistant Examiner* — Chi Q Nguyen
(74) *Attorney, Agent, or Firm* — Buchanan Ingersoll & Rooney PC

(57) ABSTRACT

A water barrier trim has a base, a top flange, and an overhang section. The base has at least one ridge extending away from the base in a first direction and a projection extending in the first direction. The top flange section is positionable adjacent to the base. The overhang section is positionable adjacent to the base and defines a drip cap. The at least one ridge is sized and configured to rest on a top of a trim board. The projection is sized and configured to fit into a slot defined in the top of the trim board to provide an interference connection.

7 Claims, 7 Drawing Sheets

WATER BARRIER TRIM

BACKGROUND OF THE INVENTION

1. Field of the Invention

The present invention relates to improvements in trim components and trim assemblies.

2. Description of the Related Art

Water intrusion around windows and doors is highly problematic for builders and building owners. This area is a large source for costly repair work. A proper seal around windows and doors requires the use of several different products which must all be installed properly. These products are typically installed by different contractors that do not necessarily interact or communicate with a prior contractor to know what has been installed.

For example, a first contractor is typically responsible for installing a moisture barrier wrap on the exterior sheathing of the house. This wrap may require that a peel and stick foil tape is used where the wrap meets the house at any cut areas or non-overlapping edges. The tape is sometimes not installed correctly or not installed at all. Typically a second contractor will apply siding to the house and is also responsible for installing trim. If water is found to bypass around the door or window all contractors may be involved and may be required to remove their work to remedy the problem. This can be very time consuming and costly.

The installation of these components is usually done by contractors who are experienced in building construction. But many home owners desire to install trim on their own homes. A simpler installation system may mitigate the confusion and possibility of missing a critical step, along with allowing the installation to be performed by a home owner or contractor that is a novice in building construction. Consequently, there is a need for a trim system that is easy to install and may reduce the costs associated with installing trim or siding around window or door openings. There is also a need for a trim system that protects against water intrusion around window and door openings and is also easy to manufacture.

SUMMARY OF THE INVENTION

A water barrier trim is disclosed herein that has a base, a top flange, and an overhang section. The base has at least one ridge extending away from the base in a first direction and a projection extending in the first direction. The top flange section is positionable adjacent to the base. The overhang section is positionable adjacent to the base and defines a drip cap. The at least one ridge is sized and configured on the base to rest on a top of a trim board. The projection is sized and configured to fit into a slot defined in the top of the trim board to provide an interference connection. Additionally, the base, the top flange section, and the overhang section can be formed integrally or separately through molding or extrusion.

In another preferred embodiment the water barrier trim further comprises a trim board having a top, a bottom, a front, and a back. The top has a middle and a slot defined in the middle. The at least one ridge rests on the top of the trim board. The projection is located in the slot in the top of the trim board and provides an interference connection.

In another preferred embodiment the water barrier trim has a trim board and a water barrier. The trim board has a top, a bottom, a front, and a back. The water barrier has a base, a top flange section, and an overhang section. The base has a top and a bottom. The top flange section is attached to the base. The overhang section is attached to the base and defines a drip cap. The bottom of the base of the water barrier is attached to the top of the trim board and the water barrier and the trim board are formed such that the trim board and the base of the water barrier are an integral unit.

In another preferred embodiment the base, the top flange section, and the overhang section are formed such that the base, the top flange section, and the overhang section are a single integral piece.

In another preferred embodiment the water barrier trim is a plastic extrusion.

In another preferred embodiment the top flange section has a structure to allow the top flange section to be fastened to a surface. The structure is a plurality of apertures or an adhesive such as cyanoacrylate, or plastic cement.

In another preferred embodiment the top flange section has peel and stick tape attached to seal the top flange section to a surface.

In another preferred embodiment the water barrier trim is located adjacent to a window, door, or other structure of a building.

The water barrier trim offers an all inclusive system. The water barrier trim can be offered as a ready to assemble system of components or a completed integral system that is ready to cut and install. The ready to assemble approach offers flexibility to address various situations as they may arise during construction.

The water barrier trim includes a base of typical dimensions, an overhang section that defines a drip cap, and a top flange section of thin gauge polyvinyl chloride ("PVC") that could have predefined holes or an adhesive. The top flange section may also include peel and stick tape such as foil tape. The overhang section and the top flange section could be co-molded to a cellular PVC trim board in a single operation or sold as a component that has a projection that is inserted along a channel or into a slot in a trim board. The geometry of this channel or slot and projection or tab are engineered as to produce a tight interference connection between the water barrier trim and the trim board to prevent water from penetrating the trim board. This configuration also allows the overhang section to extend further than the ends of the trim board so that water is directed away from the ends of the trim board.

Other details, objects, and advantages of the invention will become apparent as the following description of certain present preferred embodiments thereof proceeds.

BRIEF DESCRIPTION OF THE FIGURES

In the accompanying drawings we have shown certain present preferred embodiments of our water barrier trim in which.

DESCRIPTION OF THE PREFERRED EMBODIMENTS

Figure 1:
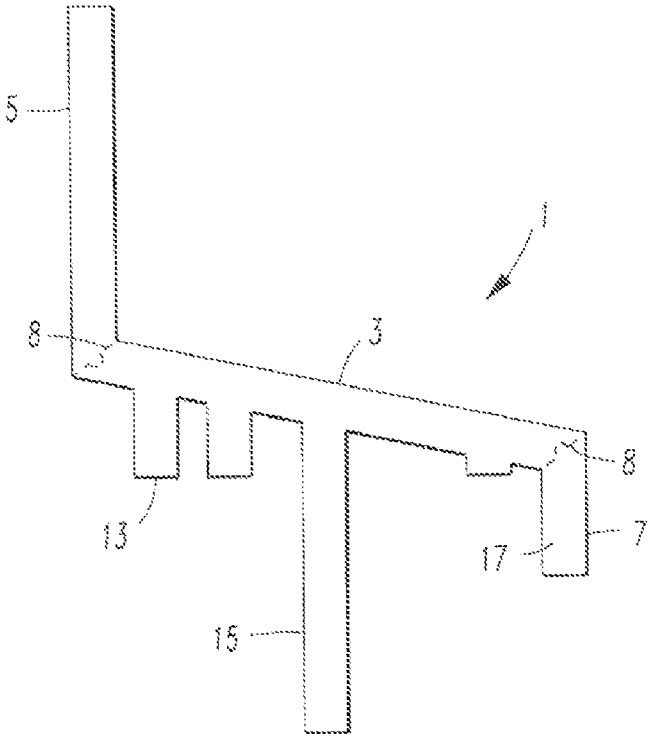
FIG. 1 is an end view of a present preferred embodiment of our water barrier trim.

Referring to FIG. 1, the water barrier trim 1 has a base 3, a top flange section 5, and an overhang section 7. At least one ridge 13 extends away from the base 3 in a first direction, and a projection 15 extends in the first direction. The top flange 5 section is positionable adjacent to the base 3. The overhang section 7 is positionable adjacent to the base 3 and defines a drip cap 17. The at least one ridge 13 is sized and configured to rest on the top of a trim board. The projection 15 is sized and configured to fit into a slot defined in the top of the trim board to provide an interference connection.

Figure 1A:
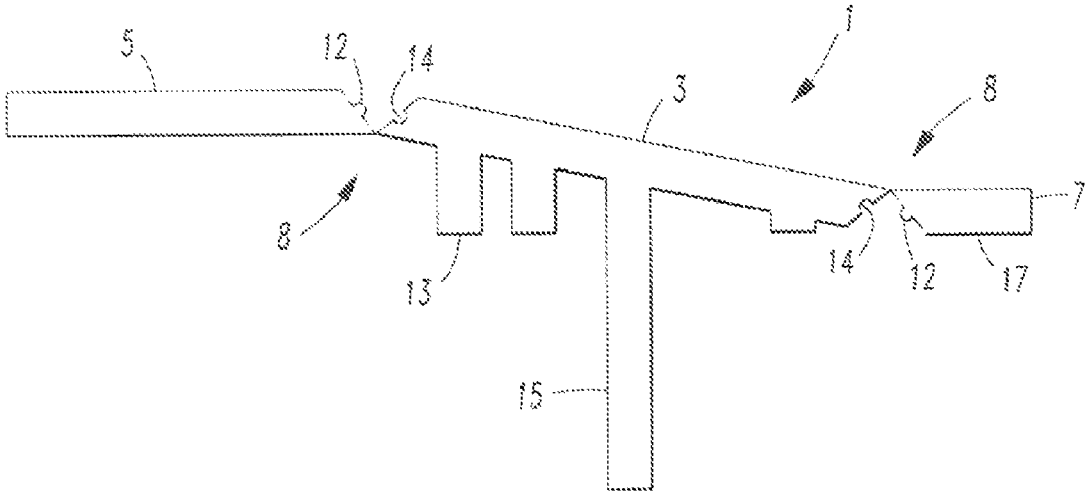
FIG. 1*a* is an end view of a second preferred embodiment of our water barrier trim.

FIG. 1*a* shows a second preferred embodiment of the present invention, similar to the embodiment of FIG. 1, in which the water barrier trim 2 further includes a hinge structure 8 shown in dotted line in FIG. 1 with an interlocking tongue 12 and groove 14. The tongue 12 fits into the groove 14 to allow the top flange section 5 to be held in an upward position. The tongue 12 and the groove 14 also allow the overhang section 7 to be held in an downward position. The hinge structure 8 allows the components of the water barrier trim 2 to remain integrally connected and to allow for easier alignment of the tongue 12 and groove 14. Additionally, the hinge structure 8 and the tongue 12 and groove 14 allow the water barrier trim 2 to be packaged more compactly. The hinge structure 8 and the tongue 12 and groove 14 allow the water barrier trim 2 to be more planar so the water barrier trim 2 can be more easily rolled and unrolled when the water barrier trim 2 is manufactured as a plastic extrusion or molded piece.

Figure 2:
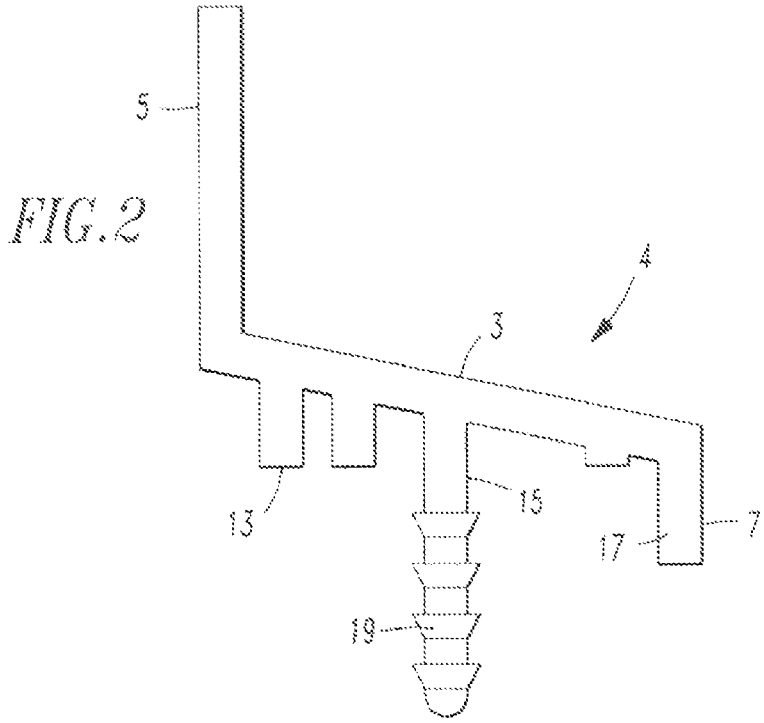
FIG. 2 is an end view of another preferred embodiment of our water barrier trim.

FIG. 2 shows another preferred embodiment of the present invention, similar to the embodiment of FIG. 1, where the projection 15 of the water barrier trim 4 includes at least one protrusion 19. The at least one protrusion 19 of the projection 15 is sized and configured to engage a slot of a trim board. The at least one protrusion 19 is sized and configured such that the amount of force necessary to remove the water barrier trim 4 from a trim board is much greater than the amount of force required to install the water barrier trim 4 to a trim board.

The geometry of the water barrier trim is engineered to produce a tight interference fit between the water barrier trim and a trim board to prevent water from penetrating the trim board. Those skilled in the art will recognize that geometries other than those shown in the drawings may be used for the water barrier trim. For example, the projection 15 may be sized and configured in an ovular shape to compress as it is inserted into the slot of a trim board or the projection may have an inverted T-shape.

The water barrier trim may be manufactured with the base 3, the top flange section 5, and the overhang section 7 formed such that the base 3, the top flange section 5, and the overhang section 7 are integrally connected or are each a separate entity. The base 3, the top flange section 5, and the overhang section 7 can be formed integrally or separately through routing, molding, extrusion, or any other preferred manufacturing technique. Of course, the water barrier trim may be manufactured as a plastic extrusion or molded in standard lengths which can be rolled and unrolled. Further, the water barrier trim and its components can be manufactured from any of a number of plastics, polymer materials, or other suitable materials, for example PVC, polypropylene, or polycarbonate.

Figure 3:
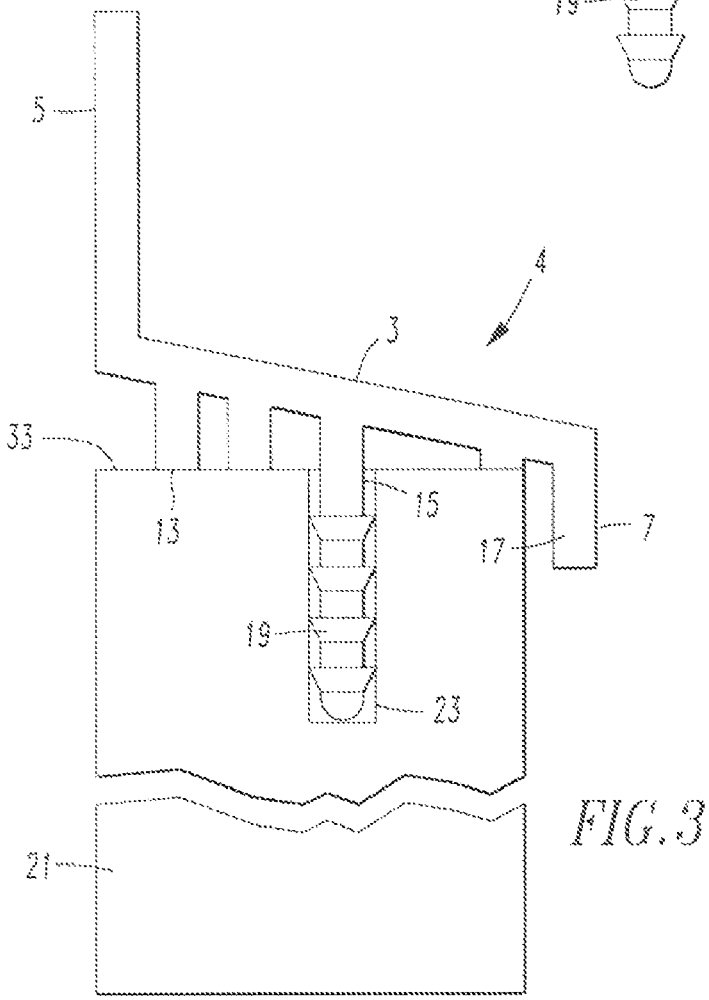
FIG. 3 is an end view of the embodiment shown in FIG. 2 engaged with a trim board.
Figure 4:
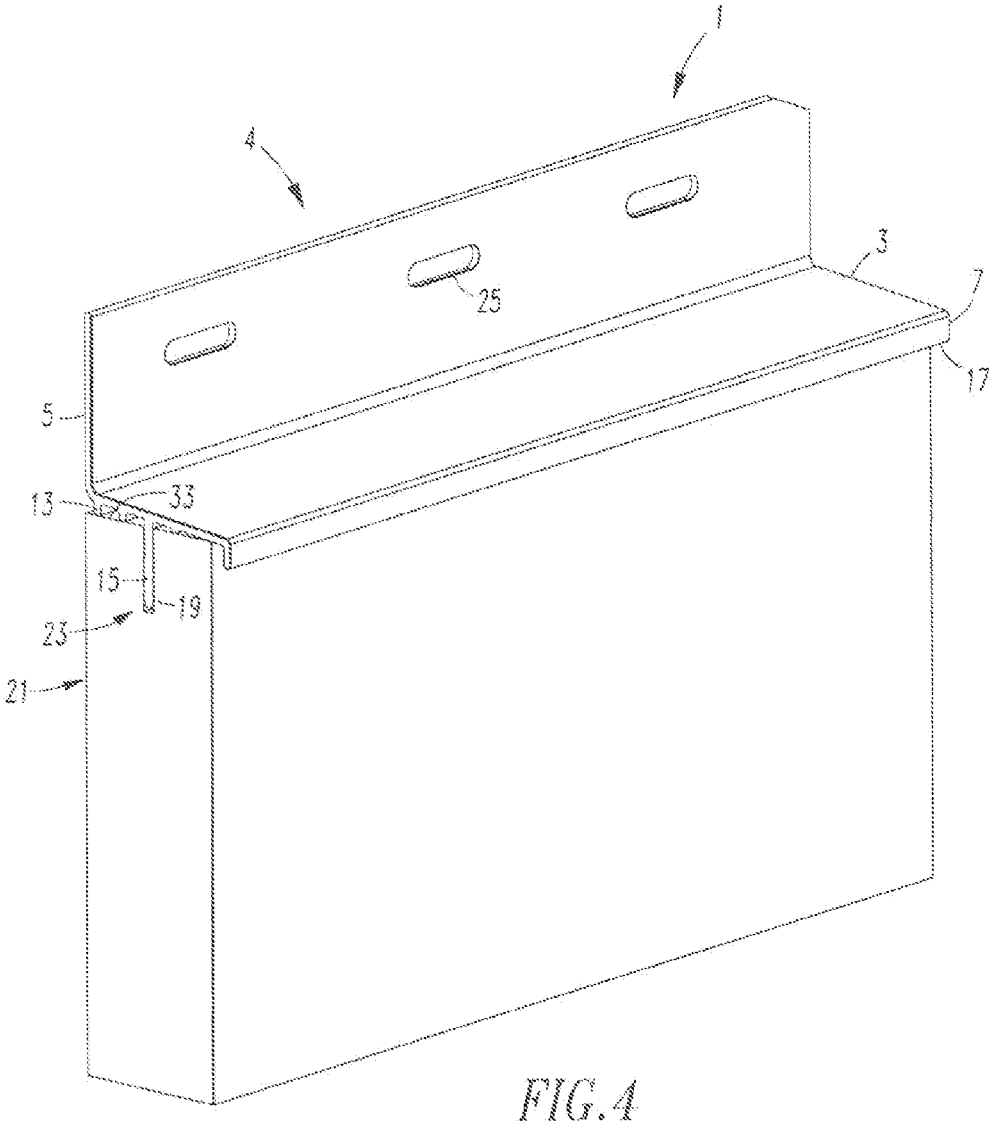
FIG. 4 is a front perspective view of the embodiment shown in FIG. 2 engaged with a trim board.

FIGS. 3-4 show the water barrier trim 4 of FIG. 2 engaged with a trim board 21. The at least one ridge 13 rests on the top of the trim board 21 providing an inclined or sloping surface to repel water downward. The projection 15 is sized and configured to fit into a slot 23 defined in the top 33 of the trim board 21 to provide an interference connection that prevents movement of the water barrier trim 4 when it is engaged with the trim board 21. Further, the at least one protrusion 19 of the projection 15 is sized and configured to engage the slot 23 to provide a fixed connection.

The slot 23 should be sized and configured in the middle of the top of the trim board to allow the universal skirt board to be used with either the front or back surface of the trim board made visible. Having a slot sized and configured in the middle of the top of the trim board allows for a different surface finish to be employed on either the front or back surface of a trim board. A user is then able to choose which surface is visible after installation.

The top flange section 5 may have a plurality of apertures 25, as shown in FIG. 4, to allow the top flange section 5 to be fastened to a surface. The top flange section may also have an adhesive, such as cyanoacrylate, or plastic cement to allow the top flange section 5 to be fastened to a surface.

Figure 5:
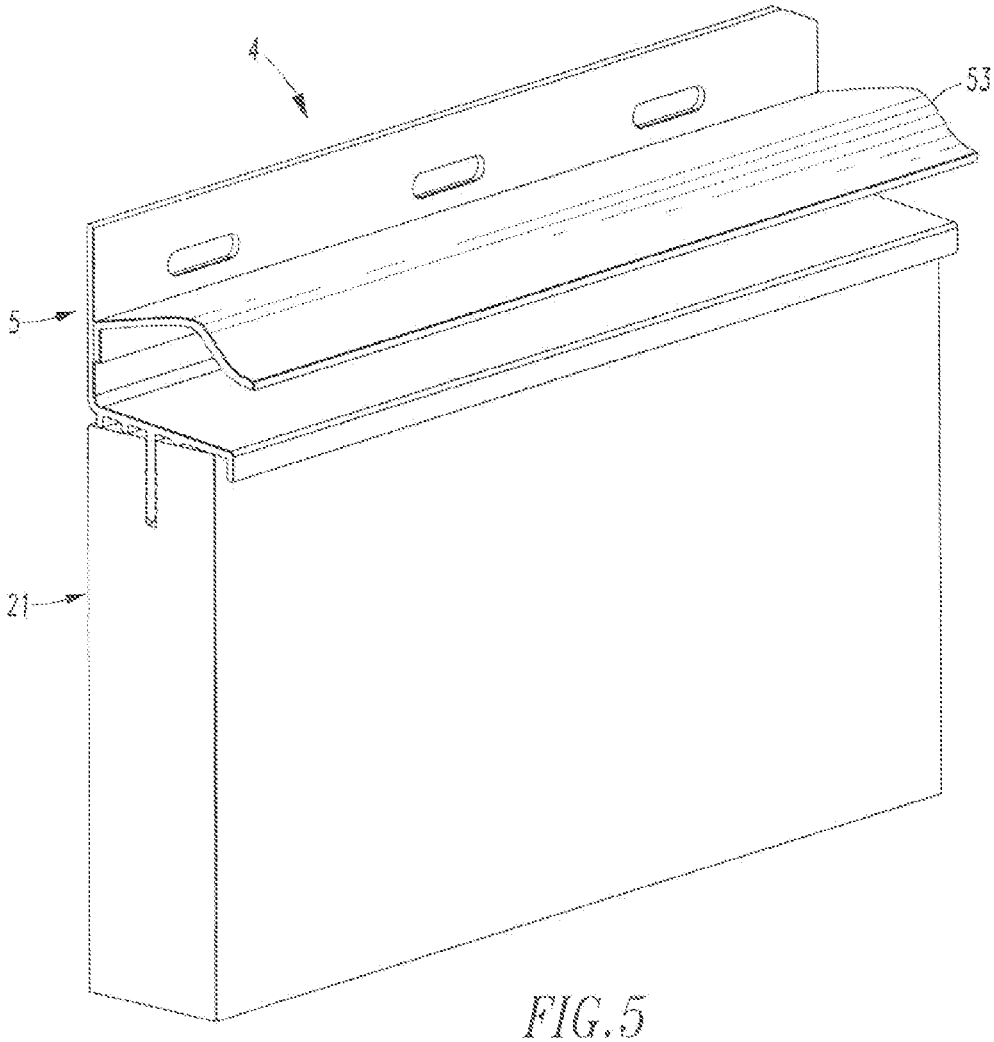
FIG. 5 is a front perspective view of the embodiment shown in FIG. 2 engaged with a trim board and the top section having peel and stick tape attached.
Figure 6:
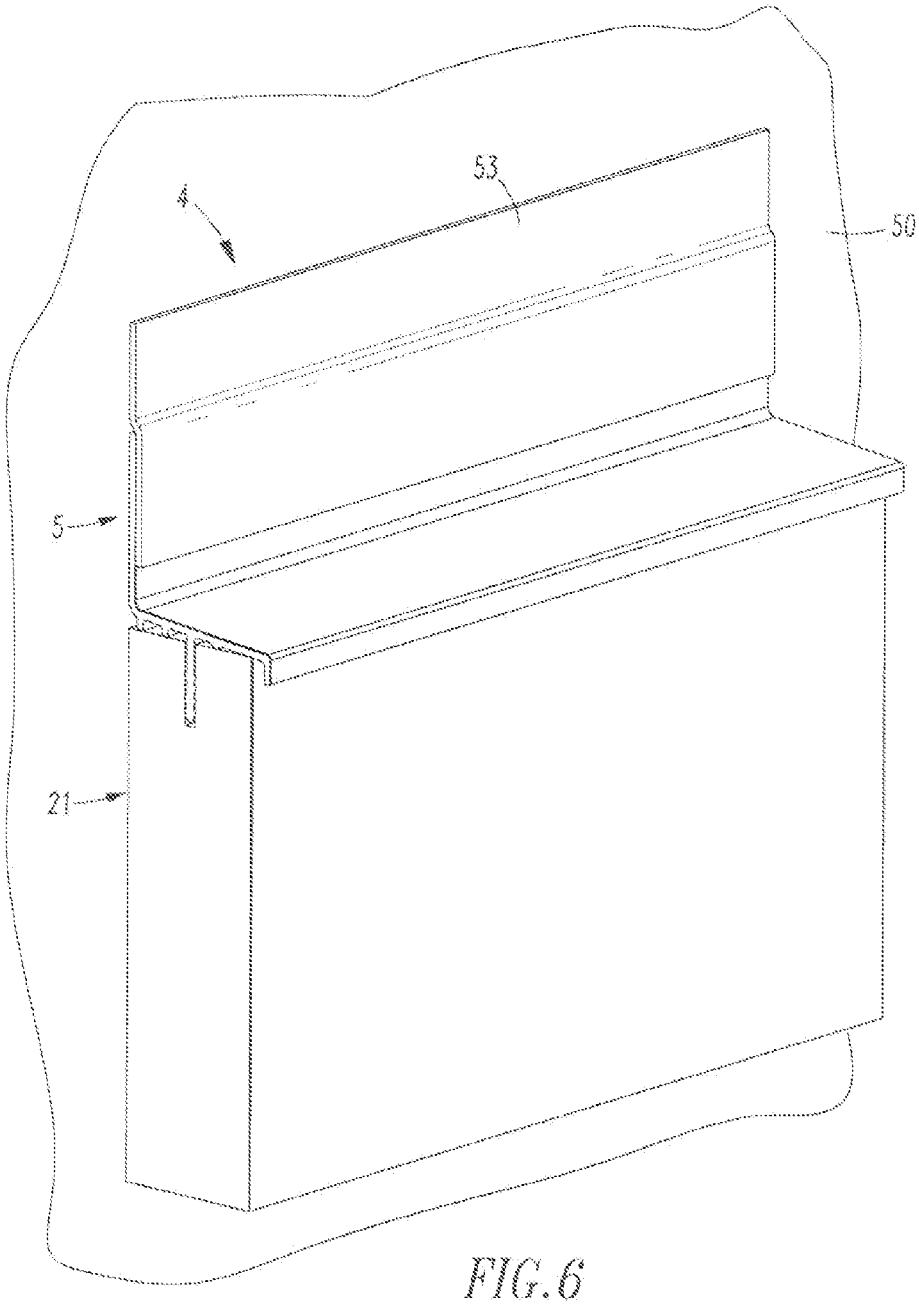
FIG. 6 is a front perspective view of the embodiment shown in FIG. 2 engaged with a trim board and the top section having peel and stick tape attached and forming a seal with a surface.

FIGS. 5-6 show another preferred embodiment of our universal skirt board 4 engaged with a trim board 21 and the top flange section 5 has peel and stick tape 53 attached. The peel and stick tape 53 allows for the top flange section 5 to be sealed to a surface 50. The seal that is formed acts as a further barrier to prevent water from entering between the top flange section 5 and the exterior of a house or building to which the universal skirt board is attached.

Figure 7:
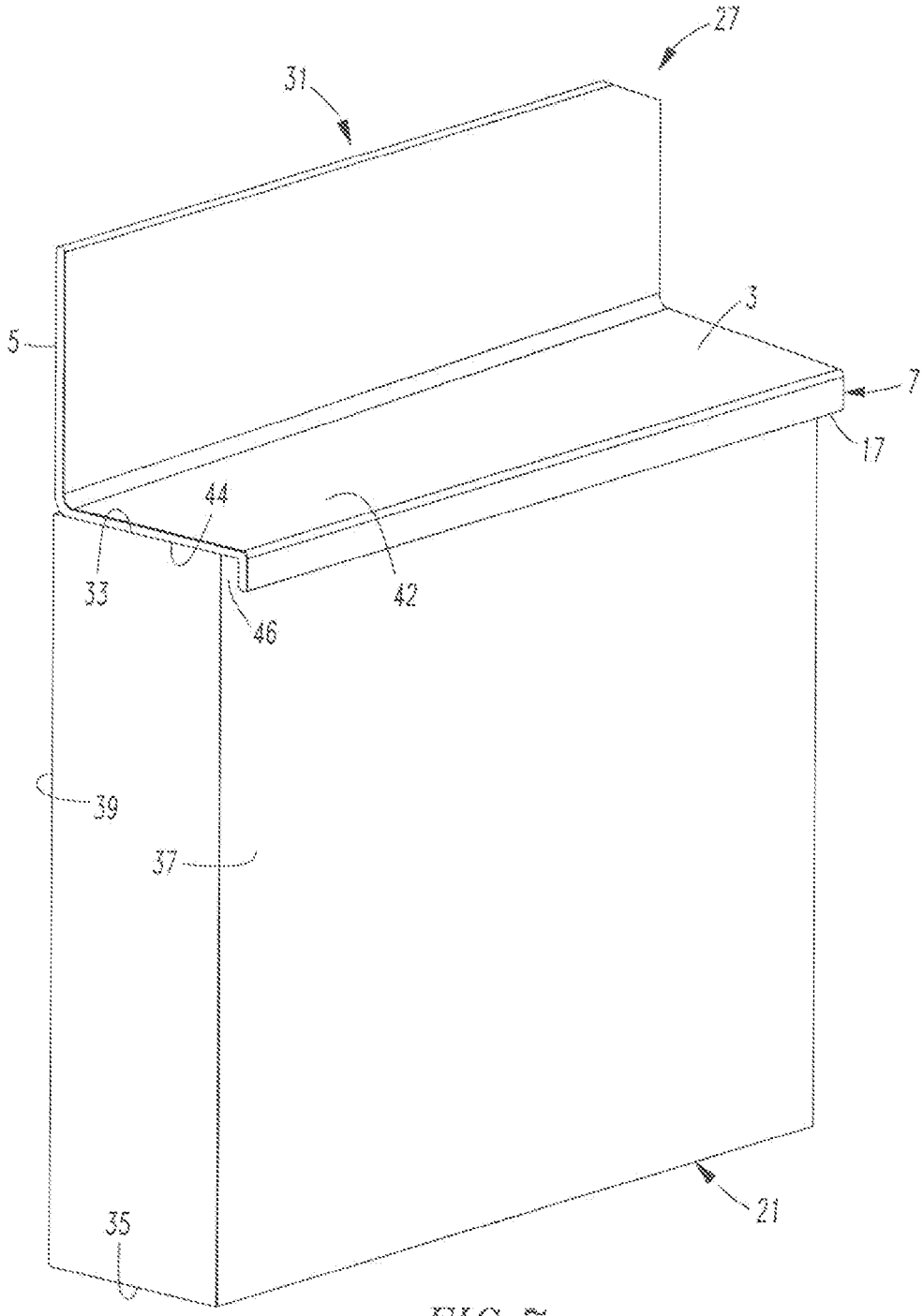
FIG. 7 is a front perspective view of another preferred embodiment of our water barrier trim.

In another preferred embodiment of the present invention, shown in FIG. 7 the water barrier trim 27 has a trim board 21 and a water barrier 31. The trim board 21 has a top 33, a bottom 35, a front 37, and a back 39. The water barrier 31 comprises a base 3 that has a top 42, a bottom 44, a top flange section 5 that is attached to the base 3, and an overhang section 7 that is attached to the base 3 defining a drip cap 17. The overhang section 7 may extend beyond the base 3 to define a gap 46 between the trim board 21 and the drip cap 17. The bottom 44 of the base 3 of the water barrier 31 engages the top 33 of the trim board 21 and the water barrier 31 and the trim board 21 are integrally connected.

Figure 8:
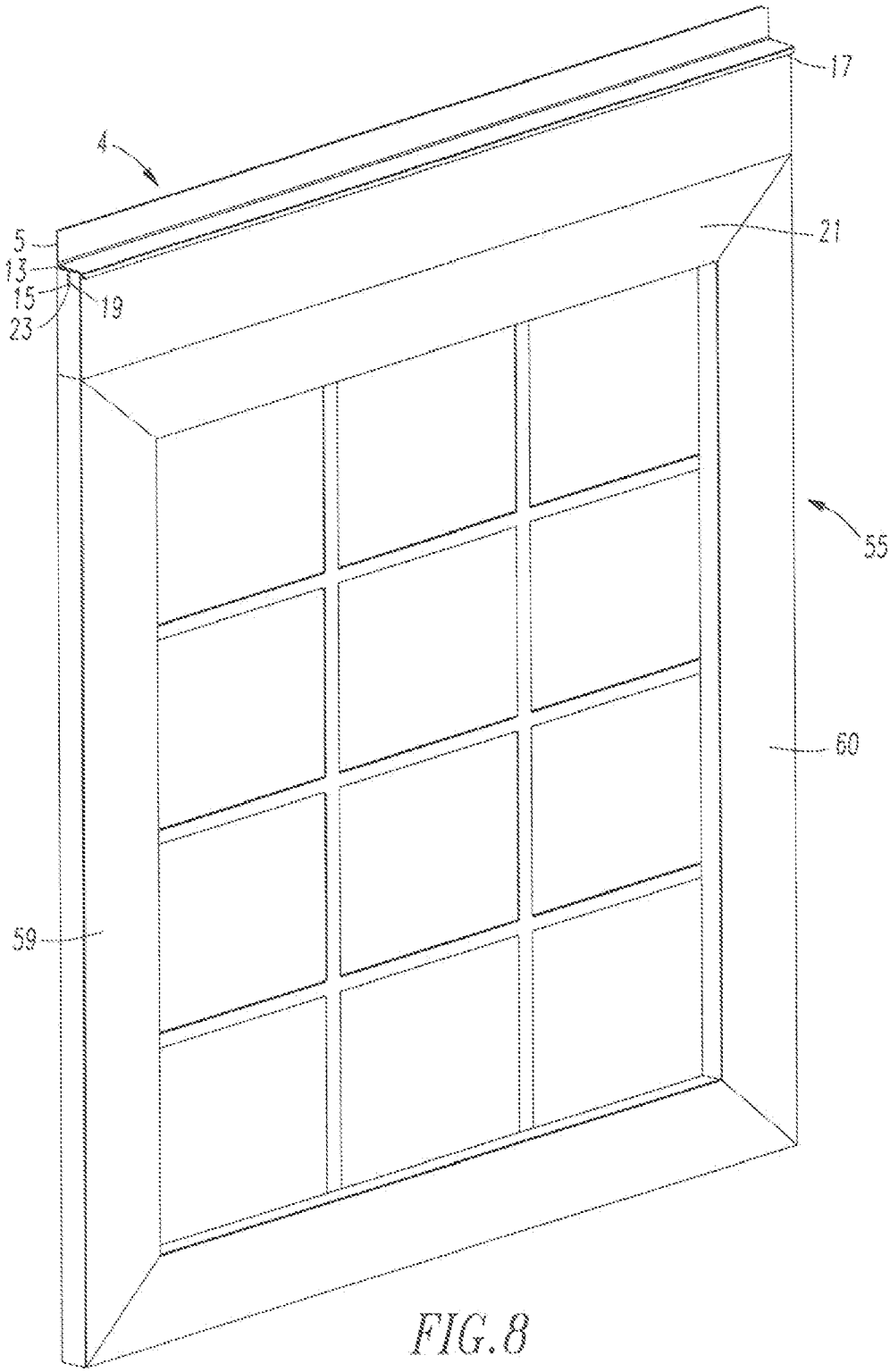
FIG. 8 is a front perspective view of the embodiment shown in FIG. 2 installed above a window.

FIG. 8 shows the water barrier trim 4 of FIG. 2 attached above a window 55. The projection 15 and the at least one protrusion 19 of the projection 15 are located in a slot 23 in a trim board 21 and provide an interference connection with the trim board 21. As water contacts the base 3 of the water barrier trim 4, the water is repelled downward towards the drip cap 17 where the water then flows outward and away from the window 55. Thus, the water barrier trim 4 diverts water from around the top 57 and side edges 59, 60 of the window 55. The water barrier trim may also be attached adjacent to a door or other structure of a building. Other structures may include a dormer or a false window.

The structure of the water barrier trim allows it to be installed with ease. The water barrier trim does not require the use of complex tools. It also reduces the amount of time and number of steps compared to standard methods for constructing similar structures.

Further, the structure of the water barrier trim allows for individuals without a high degree of skill in construction to use the water barrier trim. A novice would intuitively know to place the projection of the water barrier trim in a slot in a board based on the shape of the projection and the shape of the slot. Further, a novice would be able to fit the projection of the water barrier trim into the slot of a trim board since this is not a complex connection and does not require complex tools.

While we have shown and described certain present preferred embodiments of our water barrier trim and have illustrated certain present preferred methods of making and using the same, it is to be distinctly understood that the invention is not limited thereto but may be otherwise variously embodied and practiced within the scope of the following claims.

We claim:

1. A water barrier trim comprising:

a base having at least one ridge extending away from the base in a first direction and a projection extending in the first direction;

a top flange section positionable adjacent to the base;

an overhang section positionable adjacent to the base defining a drip cap; and a first hinge structure having a first interlocking tongue and groove, the first hinge structure attaching the top flange section to the base such that the top flange section can be positioned adjacent to the base; and a second hinge structure having a second interlocking tongue and groove, wherein the second hinge structure attaches the drip edge to the base such that the drip edge can be positioned adjacent to the base; and wherein the at least one ridge is sized and configured to rest on a top of a trim board; and wherein the projection is sized and configured to fit into a slot defined in the top of the trim board to provide an interference connection.

2. The water barrier trim of claim 1, wherein the projection has at least one protrusion, the at least one protrusion of the projection is sized and configured to engage the slot of the trim board.

3. The water barrier trim of claim 1, wherein the base, the top flange section, and the overhang section are formed such that the base, the top flange section, and the overhang section are integrally connected.

4. The water barrier trim of claim 3, wherein the water barrier trim is a plastic extrusion.

5. The water barrier trim of claim 1, wherein the top flange section has a structure to allow the top flange section to be fastened to a surface, wherein the structure is plurality of apertures or an adhesive.

6. The water barrier trim of claim 5, wherein the top flange section has peel and stick tape attached to seal the top flange section to a surface.

7. The water barrier trim of claim 1 wherein the at least one ridge extending away from the base in the first direction comprises a first ridge and a second ridge, and wherein the first ridge has a first length and the second ridge has a second length, and wherein the first length of the first ridge is longer than the second length of the second ridge.

* * * * *